US007608344B2

(12) United States Patent
Abbott, III et al.

(10) Patent No.: US 7,608,344 B2
(45) Date of Patent: Oct. 27, 2009

(54) METAL HONEYCOMB SUBSTRATES FOR CHEMICAL AND THERMAL APPLICATIONS

(75) Inventors: John Steele Abbott, III, Elmira, NY (US); Thorsten Rolf Boger, Bad Camberg (DE); Lin He, Horseheads, NY (US); Samir Khanna, Painted Post, NY (US); Kenneth Richard Miller, Addison, NY (US); Charles Mitchel Sorensen, Jr., Corning, NY (US)

(73) Assignee: Corning Incorporated, Corning, NY (US)

( * ) Notice: Subject to any disclaimer, the term of this patent is extended or adjusted under 35 U.S.C. 154(b) by 384 days.

(21) Appl. No.: 10/566,197

(22) PCT Filed: Jul. 29, 2004

(86) PCT No.: PCT/US2004/024533

§ 371 (c)(1),
(2), (4) Date: Jan. 30, 2006

(87) PCT Pub. No.: WO2005/011889

PCT Pub. Date: Feb. 10, 2005

(65) Prior Publication Data

US 2008/0138644 A1 Jun. 12, 2008

(51) Int. Cl.
*C22F 1/04* (2006.01)
*B21D 47/00* (2006.01)

(52) U.S. Cl. ..... 428/593; 72/253.1; 148/519; 148/689

(58) Field of Classification Search ..... None
See application file for complete search history.

(56) References Cited

U.S. PATENT DOCUMENTS

| | | | | |
|---|---|---|---|---|
| 3,895,899 A | | 7/1975 | Weber et al. | 425/378 |
| 4,235,583 A | | 11/1980 | Reed | 3/4 |
| 4,574,459 A | * | 3/1986 | Peters | 29/527.4 |
| 4,758,272 A | | 7/1988 | Pierotti et al. | 75/246 |
| 4,859,642 A | | 8/1989 | Hoelderich et al. | 502/2 |

(Continued)

FOREIGN PATENT DOCUMENTS

DE 3212413 A1 4/1982

(Continued)

OTHER PUBLICATIONS

Avila et al., Chemical Engineering Journal 109 (2005) pp. 11-36, "Monolithic reactors for environmental applications a review on preparation technologes".

(Continued)

*Primary Examiner*—George Wyszomierski
(74) *Attorney, Agent, or Firm*—Steven J. Scott; Kees van der Sterre

(57) ABSTRACT

Extruded metal honeycombs are produced by the direct extrusion of a softened bulk metal feedstock through a honeycomb extrusion die comprising a feedhole array for delivering softened metal through a supporting die baseplate to a honeycomb die discharge section, the discharge section comprising an array of intersecting discharge slots that form the walls of an extruded metal honeycomb structure. This process can be optimized by employing a proper pressure gradient for a particular extrudate flow rate, extrudate composition, and wall-drag condition arising from the particular composition of the feedhole wall, as illustrated graphically in FIG. 4.

13 Claims, 3 Drawing Sheets

U.S. PATENT DOCUMENTS

| | | | | |
|---|---|---|---|---|
| 4,985,230 | A | 1/1991 | Baden et al. | 423/650 |
| 5,045,403 | A | 9/1991 | Maus et al. | 428/593 |
| 5,099,085 | A | 3/1992 | Strasser et al. | 570/245 |
| 5,105,539 | A | 4/1992 | Maus et al. | 29/890 |
| 5,445,786 | A | 8/1995 | Harada et al. | 3/12 |
| 5,466,415 | A * | 11/1995 | Brundage et al. | 419/67 |
| 5,480,729 | A | 1/1996 | Hattori et al. | 428/593 |
| 5,514,347 | A | 5/1996 | Ohashi et al. | 422/174 |
| 5,660,778 | A | 8/1997 | Ketcham et al. | |
| 5,866,230 | A | 2/1999 | Maus | 428/116 |
| 5,883,138 | A | 3/1999 | Hershkowitz et al. | |
| 6,176,153 | B1 | 1/2001 | Maier | 76/107.1 |
| 6,221,308 | B1 * | 4/2001 | Peng | 264/630 |
| 6,299,813 | B1 | 10/2001 | Brew et al. | 47/12 |
| 6,417,347 | B1 | 7/2002 | Herrmann et al. | 37/2 |
| 6,417,376 | B1 | 7/2002 | Yeh et al. | 549/248 |
| 6,689,328 | B1 * | 2/2004 | Otani et al. | 422/180 |
| 6,881,703 | B2 | 4/2005 | Cutler et al. | 502/439 |
| 2002/0038062 | A1 | 3/2002 | Carmello et al. | 570/253 |
| 2004/0045267 | A1 * | 3/2004 | Ichikawa et al. | 55/523 |
| 2004/0150133 | A1 | 8/2004 | Bernas et al. | 47/12 |

FOREIGN PATENT DOCUMENTS

| | | |
|---|---|---|
| GB | 1 405 618 | 11/1972 |

OTHER PUBLICATIONS

Groppi et al., Catalysis Today 105 (2005) pp. 297-304, "Honeycomb supports with high thermal conductivity for gas/solid chemical processes".

Xu et al., M. Dekker, New York (1998), "Transformation of a structured carrier into a structured catalyst".

Williams et al., Georgia Institute of Technology (2005), "Investigation of additive manufacturing processes for the manufacture of parts with designed mesostructure".

* cited by examiner

METAL HONEYCOMB SUBSTRATES FOR CHEMICAL AND THERMAL APPLICATIONS

BACKGROUND OF THE INVENTION

The present invention relates to structured honeycomb substrates formed of metals and metal alloys, and more particularly to honeycomb structured metal substrates for the support of catalysts and/or for the management of temperatures in chemical reactors and heat exchange columns. Methods for making structured metal catalyst supports and heat exchangers by high temperature direct metal extrusion processes are also provided.

In the chemical and petrochemical industry, the performance of many processes is affected by the control and management of the released or consumed heat of reaction. As a result catalyst beds must be efficiently cooled in case of highly exothermic reactions, or heated in the case of endothermic reactions. Examples of highly exothermic reactions include the selective catalytic oxidation of organic compounds such as oxidation of benzene or n-butane to maleic anhydride, o-xylene to phthalic anhydride, methanol to formaldehyde, ethylene to ethylene oxide, and Fischer-Tropsch synthesis. Highly endothermic reactions include the steam reforming of hydrocarbons to syngas (CO and $H_2$).

Processes such as these are frequently carried out in reactors containing a large number of tubes (multi-tubular reactors), typically of the order of centimeters in diameter, loaded with appropriate catalysts in pellet or other form. Generally, such reactors are supplied from the top with reactant feeds, with or without inert components or reaction moderators, with the heat generated or required by the reaction being supplied or removed through the tube walls to a fluid heat exchange medium maintained in the spaces between the tubes. Water, thermal oil, gases, or molten salts are examples of heat exchange media that can be used.

These reactor designs are targeted at keeping the temperature inside the reactor tubes within predetermined narrow ranges since, for example, at high reaction rates the heat released in exothermic reactions can cause local superheating or thermal runaways that can result in significant reaction selectivity losses (e.g. to $CO_2$ in case of partial oxidations), catalyst deactivation or even the destruction of the reactor equipment.

These problems are aggravated by the physical limitations affecting internal heat transfer performance, e.g., the limited heat transfer coefficients and effective radial thermal conductivities of the catalysts and reactor tubes. Common approaches for dealing with these limitations include adjustments such as the staging and or grading of catalyst activity through dilutions or redistributions of the catalysts, limiting reactant throughput, or operating at high fluid flow rates. All of these methods have distinct practical shortcomings, such as increasing catalyst loading complexity, or imposing throughput limitations that reduce reactor operating efficiency, or incurring large pressure drops that again negatively impact process economics.

Catalyst supports formed from corrugated conductive metal sheets by rolling and welding or brazing processes are known, but these typically have shown thermal transfer properties equal to or worse than conventional random packings of catalyst beads, pellets, saddles or other shapes. Mesh-like supports comprising catalysts integrated into layers of fibers or wires have been proposed to enhance radial heat transfer through reactant stream turbulence, but these require efficient radial fluid transport that increases reactor pressure drop.

The use of monolithic honeycomb catalysts or catalyst supports for highly exothermic reactions such as partial oxidations has been proposed to reduce pressure drop but such supports eliminate radial fluid transport as a means of reactor temperature control. A hybrid approach to this problem for highly exothermic reactions employs assemblies of ceramic honeycomb monolithic catalyst sections alternating with packing segments for that promote effective radial mixing and heat transfer within the process stream, but the poor radial heat transfer characteristics of the honeycomb catalyst sections require that significant space be provided for the heat-exchange-promoting segments, resulting in poor reactor space utilization.

Published European patent application EP 1 110 605 provides illustrations of improved honeycomb catalyst designs intended to improve reactor heat transfer in multitubular reactors. These are honeycomb monoliths with interconnecting walls of metals or other thermally conductive materials that achieve radial heat transfer only via thermal conduction through the honeycomb structure itself. Properly implemented, this concept effectively decouples the heat transfer efficiency of a reactor from the mechanisms of radial fluid heat and mass transfer relied on in prior approaches to reactor temperature control. However, conventional metal honeycombs formed by the shaping and layering of metal sheets are typically tack welded constructions that hinder radial heat transfer due to metal contact discontinuities in their radially layered structures.

Channeled metal structures formed by the direct extrusion of metal feedstock have recently been developed for applications such as heat exchangers in HVAC systems. However, these structures are generally one-dimensional channel arrays that if layered into two-dimensional honeycomb channel arrays would present the same hindrances to radial heat transfer as the do the radially layered structures of the aforementioned European application.

Metal honeycombs formed by the extrusion of plasticized powdered metal batches, disclosed for example in U.S. Pat. No. 4,758,272, generally offer heavier constructions featuring thicker walls and wall intersections than sheet-formed honeycombs. However, these extruded honeycombs tend to retain at least some residual internal porosity that can affect strength and interfere with heat conductivity. Further, the batching, forming, and consolidation processes involved in the manufacture of metal honeycomb structures by powder batch extrusion add to the cost of these structures.

In summary, although the various types of conventional metal honeycomb monoliths have found some application in multitubular and other reactor designs for the management of heat in exothermic and endothermic reactions, there is still a need for improved monolith constructions that would provide better heat transfer performance and durability, and that could be manufactured efficiently at reasonable cost.

SUMMARY OF THE INVENTION

The present invention is aimed at providing conductive honeycombs of high mechanical integrity and strength, and of a substantial construction offering improved heat transfer, while avoiding the need to handle metal powder batches, batch extrusion aids, and extrudate post processing that add cost and complexity to conventional honeycomb extrusion manufacturing processes. These results are achieved through the use of honeycomb extrusion methods and equipment for the direct forming of solid metal honeycombs via the extrusion of bulk metal feedstocks. That is, using appropriate extruders, extrusion dies, and process controls we have found that multicellular honeycomb products of high mechanical integrity that incorporate channel wall thicknesses and cell densities effective for improved temperature control in multitubular heat exchangers and reactors for carrying out isothermal chemical processes, can be economically provided.

In a first aspect, then, the invention comprises a method for making an extruded metal honeycomb comprising heating a metal feed stock to a temperature effective to provide a softened bulk metal feed charge; forcing the feed charge into and through an array of feedholes provided in a body plate of a honeycomb extrusion die; then forcing the feed from the feedholes through an intersecting array of discharge slots in a discharge section of the honeycomb extrusion die to shape the charge into a multicellular metal extrudate having a cross-section comprising a two-dimensional array of channels defined by extruded metal channel walls, and finally cooling the extrudate to a temperature below the softening temperature of the metal feed stock.

In a second aspect the invention provides an extruded metal honeycomb product formed in accordance with the above method. That product consists of a cellular or channeled body of unitary structure incorporating a two-dimensional array of parallel channels extending in a third dimension from a first end face to a second end face of the body. The honeycomb channels are bounded by interconnecting extruded metal channel walls of a thickness in the range of about 0.025-2.5 mm (0.001-0.1 inches), and are spaced to provide a honeycomb cell density of at least 1.55 channels/cm$^2$ (10 cells per square inch [cpsi]) of honeycomb cross-section as measured transverse to the direction of channels in the array. The cross-sectional shape of the channels is not critical, but for most effective heat transfer channels with hydraulic diameters not exceeding about 4 mm are preferred. Depending on the metal feed stock employed, the extruded honeycombs of the invention could exhibit wall porosities as high as 30%, but more typically will have zero wall porosity or relatively low wall porosity not exceeding about 5% by volume.

As noted above, an important advantage of the above products and methods is the elimination of the need to utilize extrusion additives to plasticize and shape metal powders into the required products. At the same time, green perform drying, binder burn-off, and powder consolidation steps are also eliminated, the latter often requiring the use of either relatively high consolidation temperatures or isostatic pressure consolidation methods where the complete removal of powder particle boundary inclusions is required.

Finally, the use of a bulk metal extrusion process rather than a metal sheet reforming process results in a unitary honeycomb structure featuring complete radial channel wall continuity. In particular, these honeycombs comprise channel arrays that are entirely free of channel wall discontinuities such as joints, seams and welds in radial directions transverse to the direction of honeycomb channel orientation. Thus seam and/or weld discontinuities that can separate adjoining cells in honeycomb articles produced by sheet metal wrapping methods are avoided. Since thermal conductivity in the radial dimension is most critical for heat transfer in multi-tubular reactors, the feature of radial wall continuity substantially enhances the utility of these honeycombs for multi-tubular and other reactor applications wherein close process stream temperature control is required.

BRIEF DESCRIPTION OF THE DRAWINGS

The invention is further described below with reference to the appended drawings, wherein.

DETAILED DESCRIPTION

While a variety of heat-softenable metals may in principle be used to form extruded metal honeycombs in accordance with the invention, the preferred metals from the standpoint of processability and thermal performance are aluminum, aluminum alloys, copper, and copper alloys. Other heat-softenable metals of high heat conductivity such as silver and silver alloys may be used where special applications require them. The particularly preferred metals are aluminum and aluminum alloys, and the following description and examples may therefore refer specifically to the processing of those metals even though the invention is not limited thereto.

Key elements for the practice of the invention include a high temperature extruder provided with means for heating and maintaining a charge of a selected metal at a temperature at which it can be shaped by extrusion, and a honeycomb extrusion die of a design adequate for withstanding the high temperatures and pressures involved in metal reshaping. Unlike equipment for the extrusion of complex shapes from polymers or plasticized powder mixtures, the presence of heating chamber or other extruder surfaces or surface features oriented in planes transverse to the direction of extrusion should be minimized or avoided.

Figure 1:
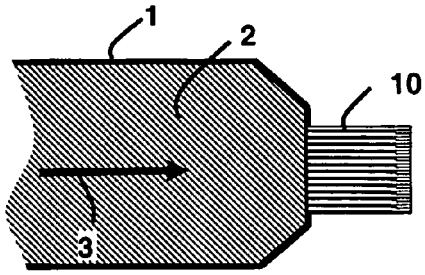
FIG. 1 illustrates a first apparatus for the extrusion of metal honeycombs.

FIG. 1 of the drawing illustrates in schematic elevational cross-section the output section of a metal extruder that may be used for the extrusion of honeycombs from a metal such as aluminum alloy. That section includes an entrance region 1 filled with a softened metal charge 2, that charge being forced in the direction of flow arrow 3 toward the inlet of an extrusion die 10 under the action of an extruder ram, not shown. The source of metal for the extruder can be bar or tubing stock, nuggets, ingots or billets. Metal powders could also be used, but are not preferred for reasons of cost and because the likelihood of charge contamination from powder additives or impurities is higher.

Honeycomb extrusion dies useful for the direct extrusion of metal honeycombs differ substantially from conventional extrusion dies used for metal forming, due to the requirement in the former case to form the entire two-dimensionally channeled honeycomb cross-section in a single unitary piece through the simultaneous extrusion of the interconnecting honeycomb wall structure across the two relatively large dimensions of the discharge face of the die. For this purpose a feedhole array is provided in the body plate of the die for distributing the metal charge uniformly over the entire die discharge cross-section, and an array of channel-forming pins securely connected with the body plate over the die discharge cross-section that together reshape the metal delivered from the feedholes into the interconnecting wall and channel structure of the honeycomb.

FIGS. 2*a*-2*e* of the drawings provide schematic perspective illustrations, in partial cutaway, plan or sectional views, of honeycomb extrusion die features such as described. Referring more particularly to FIGS. 2*a*-2*e*, extrusion die section 10 includes a die body plate 12 into which an array of feedholes 14 is provided, feedholes 14 functioning to distribute and transport a softened metal (not shown) through the body plate and toward the discharge section 16 of the die in the direction of flow arrow 3. Discharge section 16 consists of an array of anchored pins 18 separated by interconnecting discharge slots 20 for shaping the softened metal into, respectively, the honeycomb channels and interconnecting channel wall structure of an extruded honeycomb shape (not shown) that would exit the die downwardly in the die orientation shown in FIG. 2*a*, toward the viewer in the orientations shown in FIG. 2*b* and 2*e*, and upwardly in FIG. 2*d*.

Figure 2A:
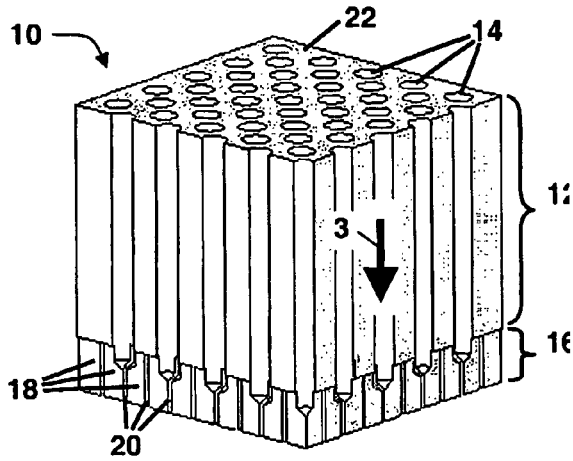
FIGS. 2*a*-2*e* illustrate designs for metal honeycomb extrusion dies.
Figure 2B:
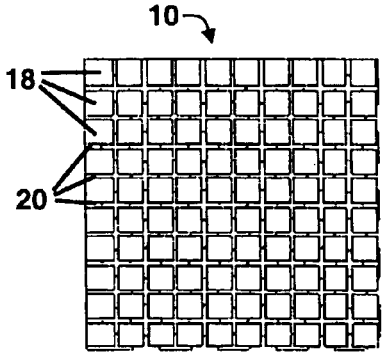
Figure 2C:
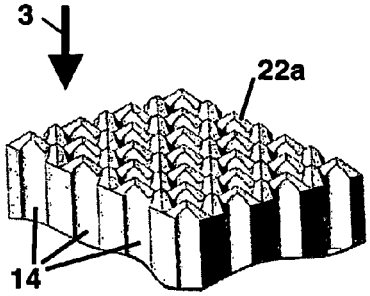

One disadvantageous feature of the die design of FIG. 2*a* is the fact that the die body plate 12 presents an inlet surface 22 that is transverse to the direction of extrusion. The die section of FIG. 2*c* illustrates an alternative design for an inlet surface 22*a* of a metal extrusion die wherein a faceted surface substantially free of surface areas oriented in a plane perpendicular to the direction of metal extrusion is provided.

Figure 2D:
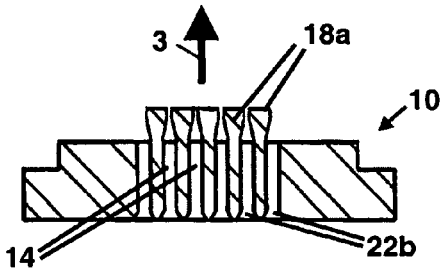
Figure 2E:
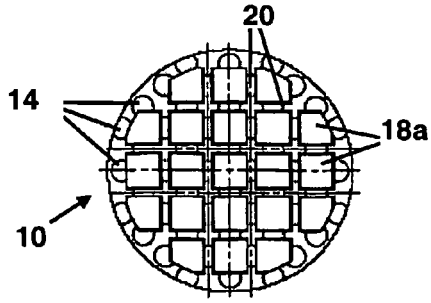

FIGS. 2*d* and 2*e* present, respectively, a schematic elevational cross-sectional view and a top plan view of a further alternative design for a honeycomb extrusion die suitable for bulk metal extrusion. FIG. 2*e* presents a view looking toward the die discharge face of the die but limited to just the active extrudate discharge section of the die. In the design of FIGS. 2*d*-2*e* the entrances 22*b* to feedholes 14 are chamfered or tapered to reduce the flow impedance into the die encountered by softened metal. At the same time, pins 18*a* forming the discharge section of the die are also tapered such that their bases at their points of attachment to the die body traversed by feedholes 14 are narrowed. Again this feature reduces metal flow impedance by reducing the extent of internal die surface area that is disposed directly transversely to the direction of flow of softened metal through the die.

It can be noted that the die design of FIG. 2*a* is a design that has body plate feedholes spaced to supply only alternate discharge slot intersections in the die discharge section. The design of FIGS. 2*d*-2*e*, on the other hand, provides a feedhole at each slot intersection and along the length of each slot. Other honeycomb extrusion die designs are also known and could be used for these extrusions, including designs wherein, for example, only the discharge slot intersections are supplied feedholes, or the feedholes are positioned away from rather than beneath the slot intersections in the discharge section.

Also useful as extrusion dies in accordance with the invention are multi-part extrusion dies, or die assemblies, that may be constructed from separate sections to form the final honeycomb die. Different materials and/or different fabrication processes may occasionally be required to separately adapt, for example, the die body plate, or the die discharge section, or the transition section bridging the body plate and discharge section, to achieve the most efficient extrusion of metal honeycombs of a particular design.

While the cell density and channel wall thicknesses of the final extruded honeycomb will be determined initially by the pin dimensions and slot widths provided in the discharge section of the extrusion die, it will be understood that products with higher cell densities and finer channel wall dimensions can be provided via further processing. For example, the initially extruded honeycomb extrudate may be drawn down, either as it exits the die or in the course of a later reforming step, to reduce the cross-section of the extrudate and, proportionally, but the sizes of the honeycomb channels and the thickness of the honeycomb walls.

The range of temperatures to which the extrusion die, inlet container, and metal feed should be heated for best extrusion results will be determined by the metal viscosity needed for effective processing through the selected honeycomb extrusion die. The flow stress of the metal should be kept low enough that the metal can be forced through the die and high enough so that the extruded honeycomb can maintain the designed geometric form. In the case of aluminum and many aluminum alloys, the temperature of the metal within the extruder will normally be in the range of about 450-550° C. to maintain best extrusion viscosities, with the exact temperature depending on the particular softening and melting temperatures of the specific metal selected.

Whereas glass materials exhibit relatively gradual melt transition behavior, i.e., small changes in viscosity with changes in temperature in over the glass transition range, the stress-strain characteristics of most metals and alloys changes sharply with temperature as their melting points are approached. For reasons of process control and because of the requirement to accurately preserve extruded shape, therefore, the forming of metals by extrusion is customarily carried out at much higher stress levels than are glass shaping processes.

Modeling calculations suggest that, without process and equipment modifications, carrying out a metal extrusion process through a honeycomb extrusion die of the type typically employed for ceramic paste extrusions would not be practical. Certainly at metal softness values conventional for metal extrusion the expected extrusion pressures through conventional honeycomb dies would be many times those for which such dies have traditionally been designed.

Pressure drops experienced in flow streams traversing the feedhole and discharge slot sections of honeycomb extrusion dies like those shown in FIG. 2*a* of the drawing can be estimated from the fully developed velocity profiles in those sections. The estimation is based on the assumption that the flows have no radial or lateral component and no stream-wise gradients.

Figure 3:
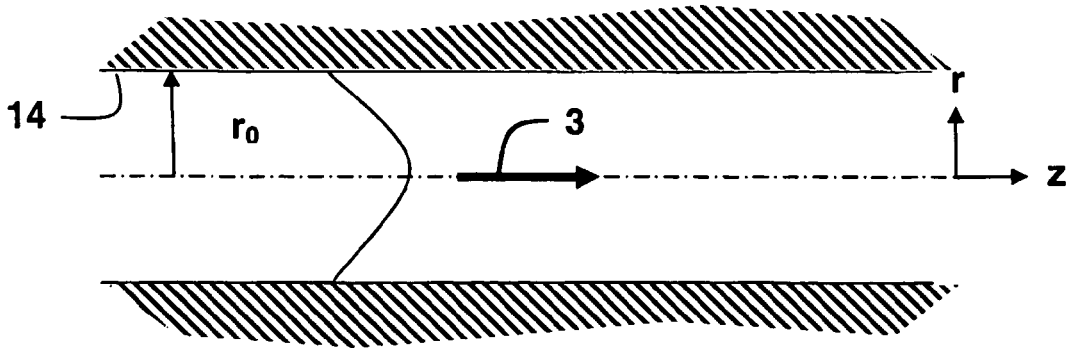
FIG. 3 illustrates geometric variables affecting the performance of a representative feedhole provided in a honeycomb extrusion die.

A schematic diagram of flow through a die feedhole 14 in the direction of a flow arrow 3 is presented in FIG. 3 of the drawings. The flow governing equation for the feed-hole reduces to:

$$\frac{\partial P}{\partial z} = \frac{1}{r}\frac{\partial}{\partial r}(r\tau_{rz}) \tag{1}$$

where P is the pressure, and $\tau_{rz}$ is the shear stress. Integrating equation (1) and imposing the restriction that stress be finite at r=0 yields:

$$\tau_{rz} = -\frac{Gr}{2} \tag{2}$$

where $G=-\partial P/\partial z$.

For aluminum and common aluminum alloys the shear stress is given by:

$$|\tau_{rz}| = k\left(\left|\frac{\partial w}{\partial r}\right|\right)^n \tag{3}$$

where w is the axial velocity, k is the stress coefficient and n the stress power-law index. For this analysis the flow is assumed to be in the positive z direction of flow arrow 3 in FIG. 3, so that G is positive and $\partial w/\partial r$ is negative. Substitut ing equation (3) in equation (2) and accounting for absolute values yields:

$$k\left(-\frac{\partial w}{\partial r}\right)^n = \frac{Gr}{2} \text{ or } \frac{\partial w}{\partial r} = -\left(\frac{G}{2k}\right)^{1/n} r^{1/n}. \tag{4}$$

The most general wall boundary condition for this flow is given by:

$$\tau_w = -\beta w^m{}_w \tag{5}$$

where $\tau_w$ is the wall shear stress, β the wall-drag coefficient, m the wall-drag power-law index, and $w_w$ the flow velocity at the wall. The value of the wall-drag coefficient β can range from 0 to ∞, a zero value corresponding to the case of perfect slip of the extrudate past the feedhole surface and the infinite value to a no-slip boundary condition wherein no slip along the feedhole surface occurs and laminar flow of the extrudate across the entire feedhole cross-section must be developed. It will be apparent that this boundary condition has critical implications for the practicality of the honeycomb extrusion process using such dies. Solving for (4) and imposing the boundary condition (5) yields:

$$w = \left(\frac{G}{2k}\right)^{1/n}\left(\frac{n}{n+1}\right)(r_0^{1+1/n} - r^{1+1/n}) + \left(\frac{Gr_0}{2\beta}\right)^{1/m}. \tag{6}$$

Equation (6) gives in most general terms the axial velocity profile of a flow stream within a feedhole. The exact profile will depend on the pressure gradient G. Alternatively, equation (6) can be used to calculate a pressure gradient required for a certain flow or honeycomb extrusion rate.

The flow rate, Q, through the feedhole is given by $$Q = 2w_0\left(\frac{2}{\sqrt{\rho_c}} - w_0\right)v_e = \int_0^{r_0} w2\pi r dr \tag{7}$$

where $v_e$ is the extrusion velocity. Substituting equation (6) in equation (7) yields:

$$Q = \frac{\pi n}{(3n+1)}\left(\frac{G}{2k}\right)^{1/n} r_0^{3+1/n} + \left(\frac{Gr_0}{2\beta}\right)^{1/m} \pi r_0^2. \tag{8}$$

Equation (8) can then be solved to get the required pressure gradient for a particular extrudate flow rate, extrudate composition, and wall-drag condition arising from the particular composition of the feedhole wall.

Figure 4:
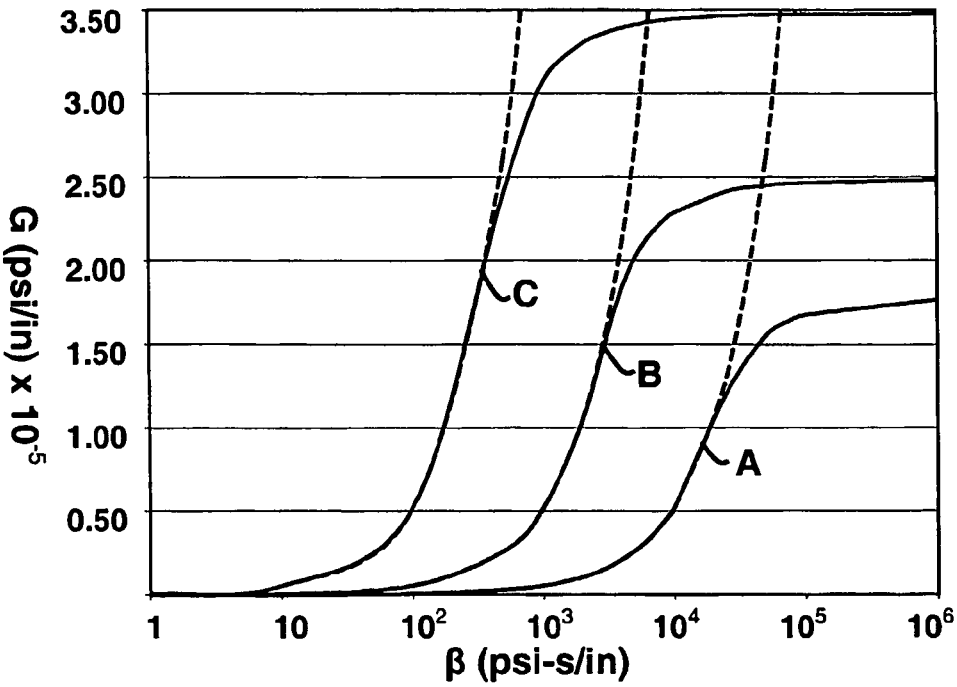
FIG. 4 plots data correlating pressure gradients with extrusion die slip characteristics in a metal honeycomb extrusion process.

Numerical solutions of equation (8) for a honeycomb extrusion die of a geometry such as shown in FIG. 2*a* of the drawings are plotted in FIG. 4 of the drawings FIG. 4 graphs the pressure gradients G arising within metal feed streams traversing a typical honeycomb extrusion die feedhole such as illustrated in FIG. 3 as a function of the wall-drag coefficient β imposed by the feedhole wall. The calculations are for three different target extrusion velocities (linear rates of honeycomb emergence from the die discharge section) at extrudate softness levels typical of those employed in metal extrusion processes. The three extrusion velocities plotted correspond to extrusion velocities of 0.25 cm/sec (Curve A), 2.5 cm/sec (Curve B), and 25 cm/sec (Curve C). A value of 1 for the wall-drag power-law index is assumed.

As the plotted data suggest, the developed pressure gradients drop rapidly below certain threshold levels of β, the latter thresholds depending upon the particular extrusion rate required. For large values of β, the pressure gradients asymptote to the no-slip values given by:

$$G = 2k\left(\frac{Q\{3n+1\}}{\pi n r_0^{3+1/n}}\right)^n. \tag{9}$$

More generally, this relationship can be expressed as:

$$G = A_f v^\mu{}_e \tag{10}$$

where $$A_f = 2k\left(\frac{2w_0(2/\sqrt{\rho_c} - w_0)(3n+1)}{\pi n r_0^{3+1/n}}\right)^n. \tag{11}$$

The total extrusion pressure for the feed-hole part can then be approximated by:

$$P_e = (A_f l_f) v^n{}_e \tag{12}$$

where $l_f$ is the length of the feedhole. For smaller values of β the second term on the right-hand-side of (8) dominates, so that the pressure gradients are simply given by:

$$G = \frac{2\beta}{r_0}\left(\frac{Q}{\pi r_0^2}\right)^m \tag{13}$$

Those gradients are plotted as the dotted line extensions of the Curves A, B and C in FIG. 4 of the drawings. In the limit, the pressure gradient can be expressed as $$G = A'\beta v_e^m \tag{14}$$

where $$A'_f = \frac{2}{r_0}\left(\frac{2w_0[2/\sqrt{\rho_c} - w_0]}{\pi r_0}\right)^m. \tag{15}$$

Equations (9) and (13) confirm that higher feed-hole diameters can significantly reduce the pressures required for extrusion. Similar pressure gradient analyses can be applied to the slotted discharge sections of these dies, and such analyses will similarly confirm that wider slot widths will reduce overall extrusion pressures. Unfortunately, the use of large feedholes and slot widths is counter to the objective of providing an extruded metal honeycomb combining high thermal conductivity with low effective hydraulic diameter, i.e., a cell density sufficiently high to effectively control reactant stream temperatures in chemical reactors.

Immediately evident from the solutions plotted in FIG. 4 are the dramatic effects of both extrusion velocity and the wall-drag coefficient β on the pressure gradients developed within the feedholes. These indicate that the range of extrusion velocities and wall-drag coefficients that will confine the required extrusion pressures to levels that can be tolerated by honeycomb extrusion dies of the kinds shown in FIG. 2*a* is limited. Based on the above analyses and the solutions plotted in FIG. 4, projections can be made of the worst-case extrusion pressures that would be developed within a die of that kind having geometry suitable for providing a honeycomb of improved heat management characteristics. One such geometry is set forth in Table 1 below:

TABLE 1

Honeycomb Extrusion Die Parameters

| Die Design Parameter | Parameter Value |
|---|---|
| Honeycomb Cell Density (cpsi) | 200 |
| Discharge Section Slot Width (inches) | 0.0182 |
| Discharge Section Slot Depth (inches) | 0.3 |
| Body Plate Feedhole Diameter (inches) | 0.076 |
| Body Plate Feedhole Depth (inches) | 1.14 |
| Feedhole/Slot Overlap Depth (inches) | 0.04 |

Assuming an extrusion velocity of 2.5 cm/sec and a worst case (no-slip) condition at extrudate-extrusion die interfaces (i.e., the case of $\beta=\infty$)), extrusion pressures for a die of the design of Table 1 above would approach 268,000 psi at the feedhole entrance and 165,000 psi at the entrance to the discharge section of the die. Conventional steel extrusion dies of these designs are not unlimited as to yield strength, particularly in the feedhole/slot transition section wherein the pins forming the slots of the discharge section are attached to the die body plate. Thus means for moderating these pressures to values that can be tolerated by honeycomb extrusion dies are important.

Among the means employed in accordance with the invention to successfully extrude metal honeycomb through honeycomb extrusion dies such as described are die designs wherein the surface areas of die entrance surfaces and/or die internal surfaces disposed in planes directly transverse to the direction of metal flow through the die are reduced or eliminated. These are best used in combination with die coatings and/or extrusion lubricants that can reduce the wall-drag coefficients of flow-aligned surfaces such as die feedhole and die discharge slot surfaces within the die.

Specific examples of die designs that can have important benefits for metal extrusion include dies having entrance surfaces and/or die internal surfaces that are inclined toward the direction of metal flow through the die, rather than being disposed in planes directly transverse to extrudate flow directions in the manner of conventional honeycomb dies used for plasticized powder batch extrusion. Specific examples of such designs are those wherein the inlet surface of the die body plate is contoured or chamfered as illustrated in FIG. 2*c* and 2*d* of the drawings. Calculations indicate that even the chamfering of feedhole entrance surfaces to an angle of 45° around each feedhole as in FIG. 2*d* of the drawings can effect a 10% pressure drop across the die inlet surface 22*b* of such a die.

Another particularly effective pressure-moderating measure for metal honeycomb extrusion is to employ a feedhole/discharge slot interface that is substantially free of surfaces disposed directly transversely to the direction of metal flow through the die. For example, in a die designed as shown in FIGS. 2*d*-2*e* of the drawings, a softened bulk metal feed delivered into the die via feedholes 14 encounters no transversely disposed surfaces within the die, but is instead gradually reshaped and reconfigured into a fully knitted honeycomb channel wall structure by the inwardly tapering side surfaces provided on pins 18*a* forming the discharge slots of the die. Further, tapering the walls of the entrance container feeding the inlet face of the die body plate whenever the extruder is of higher diameter than the die inlet surface, as shown in FIG. 1 of the drawings can also contribute to the reduction of extrusion pressure, since the amount of extruder barrel surface area disposed directly transversely to the direction of metal flow into the die is thereby reduced.

As the data plotted in FIG. 4 suggest, important benefits can also be realized through the use of release coatings on the extrusion dies and within the extruders. For example, release coatings effective to reduce wall drag coefficients ($\beta$) to values not exceeding $10^3$ psi-s/inch would enable metal honeycomb extrusion at extrusion speeds up to 2.5 cm/sec at feedhole pressure gradients not exceeding 50,000 psi/inch of feedhole length. A number of families of coatings offering improved die-feed slippage at temperatures characteristic of aluminum extrusion temperatures are known and commercially used for the production of conventional extruded aluminum products. Many of these can be readily adapted for application to honeycomb extrusion dies, for which methods of dip and vapor coating have already been developed to improve die wear performance and service life.

Dispersed graphite suspensions, soap-based lubricants, phosphate polymer preparations, and polymer-graphite mixtures are examples of liquid-applied coating materials that have been employed as die and billet coatings or lubricants in hot aluminum extrusion processes. More advanced vapor-deposited coatings, including metal nitride, carbide, and carbonitride coatings of high surface smoothness, can offer some lubrication benefits and are semi-permanent applications that can also extend service life between re-coatings. TiN, TiCN, and CrN offer some inherent lubricity and provide better release performance than chromium metal coatings. A coating system comprising a combination of TiCN and alumina, commercially available as the Bernex® HSE coating, is a specific example of an advanced coating offering improved wear and oxidation resistance for high temperature forming applications.

Because of the large impact of the wall-drag coefficient on extrusion pressure, the use of a honeycomb extrusion die wherein at least the feedholes and preferably the feedholes and discharge section of the die are provided with a vapor-deposited or liquid applied coating or lubricant selected from the above classes of coating materials constitutes a preferred method for the practice of the invention. Other approaches toward reducing extrusion pressure include mechanical measures such as ultrasonic vibration systems for reducing the extent of metal-die adhesion during the process. And, where alloys with unique thermal or chemical properties that are difficult to form must be employed, the possibility of extruding a honeycomb preform of relatively heavy wall thickness and low cell density, and subsequently redrawing that preform to reduce wall thickness and increase cell density remains an option.

Extrusion dies for honeycomb extrusion applications are most conveniently formed of machineable tool steels that can be drilled and slotted to the required configurations without loss of hardness or temper. For processes involving aluminum extrusion, tool steel hardness values above 25 RC (Rockwell "C"), preferably above 40 RC, should be used. Examples of specific tool steels suitable for this application include H11, H12, and H13 tool steels. The same and similar machinable steels can be used for the fabrication of supplemental dies or masking hardware used in combination with the primary extrusion die for purposes such as adjusting the diameter or surface finish of the extrudate. As previously noted, monolithic extruded honeycombs prepared by the methods of the invention can be used in a number of chemical and petrochemical reactions, with particular advantage in reactors wherein radial heat transfer is crucial for safe and economic reactor operation. Included are many of the processes commonly performed in multi-tubular reactors, including partial oxidations of hydrocarbons to produce species such as ethylene oxide, formaldehyde, phthalic anhydride, maleic anhydride, and methanol; oxychlorination reactions to products such as ethylene dichloride; the steam reforming of hydrocarbons to produce "syngas" ($CO + H_2$) and Fischer-Tropsch synthesis to convert $CO + H_2$ to gaseous hydrocarbons.

For these and other chemical processing applications honeycomb cell densities in the range of 10-400 cpsi are preferred as providing a good combination of low hydraulic diameter and adequate thermal conductivity. For best thermal performance channel wall thicknesses in the range of 0.010-0.050 inches that are substantially non-porous will be used. Channel shapes are not critical; honeycombs with channels having cross-sectional shapes such as round, polygonal, and internally finned configurations can be employed. Polygonal channels of 3 to 8 sides, including polygons with internally rounded corners, are suitable; triangular and quadrangular shapes are the simplest to produce with traditionally machined honeycomb extrusion dies.

The advantages of unitary non-porous metal honeycombs for carrying out reactions such as above described are several. Not only can the reactions can be carried out within significantly narrower temperature ranges than is possible with conventional catalyst packings, but reactor operation at lower pressure drops is also enabled. Better temperature control enhances process safety, increases catalyst life, improves reaction selectivity, and permits reactor operation at higher reactive heat loads for improved process efficiency. Reduced pressure drops reduce the load on pumps and compressors, decrease operating and capital costs, facilitate the use of higher recycle rates at equal or less compression demand, and enable reactor operation at near-constant pressure levels. Further, the use of monoliths facilitates the grading, loading and design of catalyst beds since the stacking of single monolith pieces within reactor tubes is highly reproducible and easy.

In most cases the catalysts provided for use with these metal catalyst supports will be applied as coatings on the internal surfaces of the honeycomb channel walls. Catalyst coatings may be applied through the use of standard methods as these have been developed commercially for applying metal and metal oxide coatings to ceramic honeycombs used for exhaust gas emissions control. The selection of an active catalyst will depend on the application but in most cases will involve straightforward adaptations of the catalysts currently used for conventional catalyst packings. Thus catalytically active metals, or oxides, sulfides, or other compounds of such metals, typically selected from the group consisting of Pt, Pd, Ag, Au, Rh, Re, Ni, Co, Fe, V, Ti, Cu, Al, Cr and combinations thereof, will most frequently be used. Alternatively, where the extruded honeycomb is itself composed of a metal or alloy having catalytic activity for a reaction of interest, surface modifications of the honeycomb channel walls may be effective to develop the desired level of activity.

The invention is further described below with reference to the following example, which is intended to be illustrative rather than limiting.

EXAMPLE

Honeycomb extrusion dies of tapered pin design are fabricated from tool steel die blanks by conventional drilling and electrical discharge machining procedures. The extrusion dies are in the form of machined disks of 2.756-inch outer diameter, having die cross-sections and layouts substantially as shown in the schematic elevational cross-section and top plan view of FIGS. **2*d*-2*e* of the drawings. The dies are 0.787 inches in total thickness, having pin lengths providing discharge slot depths of 0.236 inches and body plate thicknesses providing feedhole lengths of 0.96 inches. FIG. 2*e* illustrates the disposition of feedholes 14 with respect to discharge slots 20** in the dies.

Table II below sets forth geometric data for each of four extrusion dies configured as above described. Included for each of the dies, in addition to the above-reported slot widths and feedhole depths, are discharge slot widths, feedhole diameters, and channel or cell densities of each die in cells per $inch^2$ of honeycomb cross-section for each of the dies.

TABLE II

Honeycomb Extrusion Die Parameters

| | Extrusion Die Number | | | |
|---|---|---|---|---|
| Die Design Parameter | 1 | 2 | 3 | 4 |
| Honeycomb Cell Density (cpsi) | 40 | 40 | 15 | 15 |
| Discharge Section Slot Width (inches) | 0.033 | 0.017 | 0.033 | 0.017 |
| Discharge Section Slot Depth (inches) | 0.236 | 0.236 | 0.236 | 0.236 |
| Body Plate Feedhole Diameter (inches) | 0.095 | 0.092 | 0.147 | 0.145 |
| Body Plate Feedhole Depth (inches) | 0.55 | 0.55 | 0.55 | 0.55 |

Aluminum metal honeycombs of zero wall porosity are formed from billets of 1050 aluminum alloy using these extrusion dies. Each honeycomb extrusion die is mounted in a die support plate fit to the output section of a hydraulic metal extrusion press of the kind conventionally employed for the ram extrusion of heavy metal tubing. The extrusion press is of 8 MN capacity and includes an billet induction heating system along with a billet preheating furnace of 1300° C. heating capacity.

Each of the alloy billets selected for use these extrusion runs is 90 mm in diameter and 300 mm in length. The extruder barrel is 95 mm in diameter. These extrusion runs are typically conducted with a soap lubricant of the kind conventionally employed for aluminum extrusions. And, most runs are conducted with preheating of extrusion die to an extrusion temperature somewhat above extruder barrel temperature maintained during the runs.

Representative extrusion conditions for 8 different aluminum honeycomb extrusion runs are reported in Table III below. Included in Table III for each extrusion run are the billet preheat temperature, the target extruder barrel temperature, the cell density of the extrusion die, in cells/$inch^2$ of die cross-section, the discharge slot width of the die in inches, the target die temperature, the extruder ram speeds used during the runs, as a range from the minimum to the maximum ram speed in mm/second, and the lubricant used, if any.

TABLE III

Honeycomb Extrusion Runs

| Run Number | Billet Preheat Temperature (° C.) | Extruder Barrel Temperature (° C.) | Die Cell Density (cpsi) | Die Discharge Slot Width (in) | Die Heating Temperature (° C.) | Extruder Ram Speed (mm/s) | Extrusion Lubricant |
|---|---|---|---|---|---|---|---|
| 1 | 572 | 500 | 40 | 0.033 | 520 | 0.5-1.7 | soap |
| 2 | 564 | 500 | 40 | 0.033 | — | 0.5-0.95 | (none) |
| 3 | 556 | 500 | 15 | 0.033 | 520 | 0.5-1.1 | soap |
| 4 | 570 | 500 | 15 | 0.033 | 520 | 1.0-4.0 | soap |
| 5 | 560 | 500 | 15 | 0.017 | 520 | 0.5-4.2 | soap |
| 6 | 555 | 500 | 15 | 0.017 | 520 | 0.5-8.2 | soap |
| 7 | 559 | 500 | 40 | 0.017 | 520 | 0.5-1.1 | soap |
| 8 | 565 | 500 | 40 | 0.017 | 520 | 0.6-0.55 | soap |

Typical extruder barrel pressures determined at the extrusion die inlets with this alloy under the conditions reported in Table III are in the range of 780,000 psi at the extrusion die inlet, and in the range of 45,000 psi at the die discharge section. These limits are generally not exceeded at extruder ram speeds up to 8 mm/seconds, which depending the particular extrusion die profile produced honeycomb extrusion rates on the order of 30 meters/minute. Honeycomb extrusion rates on the order of 100 meters/minute are considered to be attainable using this equipment.

Figure 5:
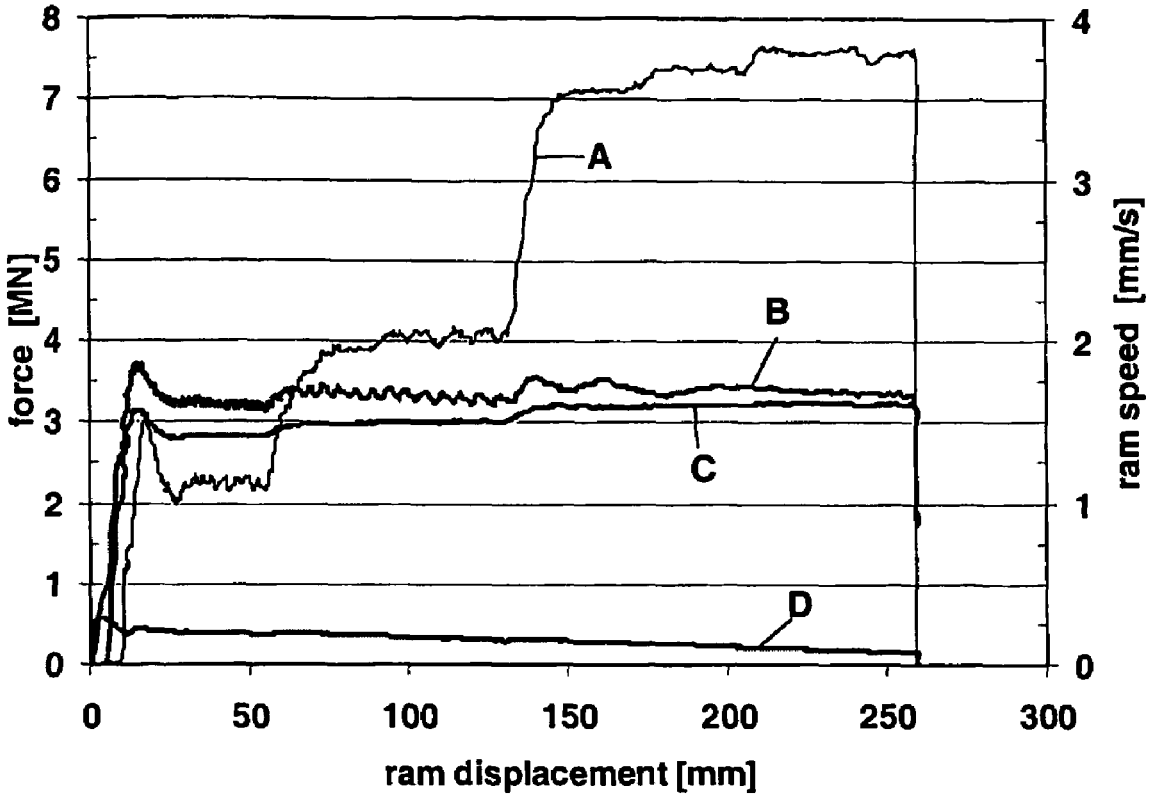
FIG. 5 plots data for a representative extrusion run to produce a honeycomb of aluminum alloy.

FIG. 5 of the drawings plots extrusion force data typical of an extrusion run such as Run 4 reported in Table III above. Extruder ram speeds reached during the run are plotted as Curve A on the right vertical axis of the graph of FIG. 3, while the resulting extrusion forces are scaled on the left vertical axis of the graph. Extruder ram force arising during the run is plotted on Curve B of FIG. 3, while extrusion force on the die is plotted on Curve C. The frictional extrusion force over the run is plotted on Curve D.

With the exception of Run 2, all of the runs reported in Table III result in good yields of extruded metal honeycomb stock. Run 2, illustrative of extrusion with no extrusion lubricant and without pre-heating the extrusion die, is shortened as the result of damage to the extrusion die. As FIG. 3 suggests, extrusion forces under the various extrusion conditions reported in Table III are found to be relatively independent of extruder ram speed.

The products of Runs 1 and 3-8 consist in each case of aluminum alloy honeycomb monoliths of 25.5 mm diameter, with regular open-celled cross-sections exhibiting cell densities of 40 cpsi or 15 cpsi that closely match the cell densities of the extrusion dies. Extrudate lengths on the order of 20 meters are obtained from each billet, depending on die design and thus metal reduction ratio, with very short discard lengths.

Of course, the foregoing description and examples are merely illustrative of the invention as it may be practiced within the scope of the appended claims.

We claim:

1. A method for making an extruded metal honeycomb article comprising the steps of:

heating a metal feed stock to a temperature effective to provide a softened bulk metal feed charge, wherein the metal feed stock does not comprise a metal powder;

forcing the feed charge into and through an array of feedholes provided in a body plate of a honeycomb extrusion die;

thereafter forcing the feed from the feedholes through an intersecting array of discharge slots connecting with the feedholes in a discharge section of the honeycomb extrusion die, thereby to shape the charge into a metal extrudate comprising an interconnected wall structure forming channels and channel walls for a metal honeycomb; and cooling the extrudate to a temperature below the softening temperature of the metal feed stock.

2. A method in accordance with claim 1 wherein the honeycomb extrusion die comprises die entrance surfaces and/or die internal surfaces that are inclined toward the direction of metal flow through the die.

3. A method in accordance with claim 1 wherein at least the feedholes are provided with at least one of (a) chamfered inlet surfaces and (b) release coatings or lubricants effective to limit the feedhole wall drag coefficient to a value not exceeding $10^3$ psi-s/inch.

4. A method in accordance with claim 3 wherein the release coating is a vapor-deposited or liquid applied coating selected from the group consisting of graphite suspensions, soap lubricants, phosphate polymers, polymer-graphite mixtures, metal nitride vapor coatings, metal carbide vapor coatings, and metal carbonitride vapor coatings.

5. A method in accordance with claim 3 wherein the release coating is a vapor deposited coating consisting of a combination of TiCN and alumina.

6. An extruded metal honeycomb article comprising:

a channeled metal body of unitary structure incorporating a two-dimensional array of parallel channels extending in a third dimension from a first end face to a second end face of the body, the channels being spaced to provide a honeycomb cell density of from 10 to 40 cells per square inch of honeycomb cross-section as measured transverse to the direction of the channels in the array; and interconnecting channel walls defining the channels, the channel walls being of a thickness in the range of about 0.001-0.1 inches from the first end face to the second end face of the body, being formed of a bulk metal having a porosity below 5% by volume, and being substantially free of channel wall discontinuities in directions transverse to the direction of honeycomb channel orientation in the article.

7. An extruded metal honeycomb article in accordance with claim 6 having a composition selected from the group consisting of aluminum, aluminum alloys, copper, and copper alloys.

8. An extruded metal honeycomb article in accordance with claim 7 wherein the channels have a cross-sectional shape selected from the group consisting of round, polygonal of 3-8 sides, polygonal of 3-8 sides with rounded corners, and internally finned shapes.

9. An extruded metal honeycomb article in accordance with claim 7 wherein the channels are of square or triangular cross-sectional shape.

10. An extruded metal honeycomb article in accordance with claim 6 which is a catalyst support.

11. An extruded metal honeycomb article in accordance with claim 6 which is a heat exchange structure.

12. An extruded metal honeycomb article in accordance with claim 6, which comprises a honeycomb cell density of from 15 to 40 cells per square inch of honeycomb cross-section as measured transverse to the direction of the channels in the array.

13. A method for making an extruded metal honeycomb article comprising the steps of:

heating a metal feed stock to a temperature effective to provide a softened bulk metal feed charge, wherein the metal feed stock is selected from bar stock, tubing stock, ingots, and billets;

forcing the feed charge into and through an array of feedholes provided in a body plate of a honeycomb extrusion die;

thereafter forcing the feed from the feedholes through an intersecting array of discharge slots connecting with the feedholes in a discharge section of the honeycomb extrusion die, thereby to shape the charge into a metal extrudate comprising an interconnected wall structure forming channels and channel walls for a metal honeycomb; and cooling the extrudate to a temperature below the softening temperature of the metal feed stock.

* * * * *